United States Patent [19]

Muneoka et al.

[11] 3,935,333

[45] Jan. 27, 1976

[54] METHOD FOR FORMING A TRANSPARENT IMAGE ON A SHEET

[75] Inventors: Harunobu Muneoka; Tuguo Nezu, both of Hiratsuka, Japan

[73] Assignee: Kansai Paint Company, Ltd., Tokyo, Japan

[22] Filed: Dec. 15, 1972

[21] Appl. No.: 315,472

[30] Foreign Application Priority Data

Dec. 18, 1971 Japan ..... 46-103046

[52] U.S. Cl. ..... 427/49; 427/12; 204/2; 178/62; 428/263; 427/273; 427/277

[51] Int. Cl.[2] ..... B41C 3/08

[58] Field of Search ..... 117/212; 204/2; 156/3; 178/62; 427/12, 49, 273, 277

[56] References Cited

UNITED STATES PATENTS 2,884,313 4/1959 Browne ..... 156/3

3,122,448 2/1964 Hills et al. ..... 204/2 X

*Primary Examiner*—John D. Welsh

*Attorney, Agent, or Firm*—Wigman & Cohen

[57] ABSTRACT

A transparent image forming sheet and method for forming transparent images on the sheet, in which the sheet comprises a transparent film base, an opaque conductor layer being formed on one side of the transparent film base and a semiconductive layer containing powder of metallic oxide semiconductor, a mixture of non-conductive metallic compound and conductive substance, or polymeric semiconductor, and the method comprises the steps of applying electric voltage between the semiconductive layer and the conductor layer through recording stylus and development using corrosive liquid and/or dissolving solvent.

The transparent image sheet can be used for several optical purposes including the preparation of a printing plate for photographs without the screen process.

10 Claims, 4 Drawing Figures

METHOD FOR FORMING A TRANSPARENT IMAGE ON A SHEET

This invention relates to the method for producing transparent image on an image forming sheet.

More particularly, the invention relates to method for producing a transparent image on a sheet which can be used as the negative or positive for several purposes such as photographic printing, photographic copying, image forming on photosensitive printing plate or the like.

By using the transparent image forming sheet of the present invention, the electric signal can be directly converted into and recorded as a clear and transparent image on the sheet. Therefore, when image informations are received from a distant place through wire or wireless transmission, it is not necessary to take a process for converting into light in order to obtain a visible image. Accordingly, the printing (photographing or press) process and the copying process can be improved and simplified.

The recording sheet for electric discharge, useful as a transparent image forming sheet, is well known in the prior art. Such sheet is composed of a transparent base sheet and metallic conductive layer onto which an opaque dielectric layer is formed. In the course of image formation, the upper two layers are ruptured by the heat of the electric discharge and the transparent base sheet is exposed at the image line by the heat of the electric discharge.

Further, it is also known that such recording sheet can be used for optical copying processes. However, in the above-mentioned conventional method, the image formation depends upon the destructive actions to the metallic layer and the dielectric layer. Therefore, a relatively high voltage such as 70 volts or higher is necessary for the conventional discharge recording, in addition to that, there are many other disadvantages that unpleasant noises, offensive odors and smoke are produced during the recording, and the wear of the recording stylus is considerably large. Still further, as the most serious disadvantage, the resolving power of the recorded image is not satisfactory, because the image is expanded around the contact area of the top portion of recording stylus during the electric discharge.

The object of the present invention is to provide a method for producing clear transparent image on the image forming sheet, in which the disadvantages caused in the above-mentioned conventional method can be removed.

Further object of the invention is to provide the novel image forming sheet which can be used easily and economically without causing any troubles such as noise, offensive odor and smoke as the recording signal voltage is very low as compared with the known ones and the phenomenon of electric discharge does not result.

Still another object of the invention is to provide the novel image forming sheet which can be formed with clear and transparent image having excellent resolving power through a quite simple development process.

Moreover, the present invention has an object to provide a transparent image sheet available as a negative for preparation of a printing plate for photographs without a half-tone process or a screen process.

Pursuant to the above objects, the present invention is quite different from the above-mentioned conventional method. That is, the image forming sheet of the invention comprises a transparent film base, an opaque conductor layer being formed on one side of the film base, and a semiconductive layer being formed on the opaque conductor layer. The semi-conductive layer is applied with an electrode, and in the portion to be formed with image, electric signal voltage is supplied between the electrode and the conductor layer, thereafter the image portion is made transparent selectively by the use of a corrosive liquid or a solvent which dissolves the semiconductive layer.

These and other objects and features of the invention will become more apparent from the following description taken in connection with the accompanying drawings in which:

FIG. 3 (*b*) is a schematic sectional view of the image forming sheet after the physical development.

Figure 1:
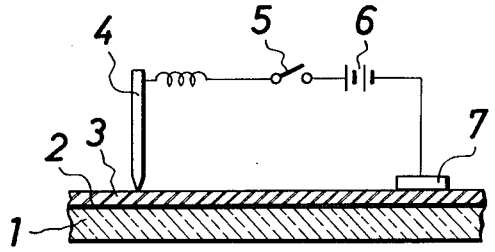
FIG. 1 is a schematic illustration partly in section of the image forming sheet of the invention and the apparatus to form the image.

Now, referring to FIG. 1, the image forming sheet of the invention consists of a transparent or translucent film base 1, an opaque conductor layer 2 and a semiconductive layer 3. The film base 1 is, for example, made of transparent plastics, regenerated cellulose, glass and the like. The opaque conductor layer 2 is, for example, a thin layer of vapor deposited metallic coating, a leaf or foil or metal being adhered to the surface of the film base 1, or a layer of conductive coating composition containing as the main component conductive particles such as metallic powder, conductive carbon black, conductive graphite powder or the like. Further, as the semiconductive layer 3, there are three types of components which may be used. That is, one of them is a semiconductive material which can be formed into a layer, for example, a homogeneous layer of conductive polymer. The other one is a semiconductive composition where fine particles of semiconductive material which is insoluble in non-conductive binder is dispersed in said binder in a concentration that said particles electrically contact with each other to form as a whole a semiconductive material, for example, a dispersion of semiconductive metallic oxide powder. The third one is a semiconductive composition made from a mixture of non-conductive fine particles and conductive fine particles in a proportion to form as a whole a semiconductive material dispersed in a non-conductive binder as hereinafter defined, for example, a dispersion of a mixture of non-conductive metallic oxide powder and conductive carbon black. A needle electrode or a recording stylus 4 is contacted to the surface of the semiconductive layer 3 and moved on the surface, and an electrical signal is supplied from an electric power source 6 by the action of a switch 5 in response to the image to be formed. The electric current is returned to the electric power source 6 through a return electrode 7. The positive and negative polarity of the electric power source 6 can be reversed and AC power can also be used in place of the DC power source 6 which is shown in FIG. 1. The return electrode 7 may be connected to the conductor layer 2 directly, however, if the return electrode 7 is provided with a sufficiently large contact area as compared with that of the recording stylus 4, the circuit can be formed through the semiconductive layer 3 as shown in FIG. 1, in which the resistance of the circuit in that portion is negligible. Further, only for the case where an AC voltage is applied, the return electrode wide enough to cover the whole area for image forming may also be contacted to the backside of the transparent film base which is dielectric, because there can be formed a complete electric circuit due to the capacitance of the film base. That is, in the case of using a facsimile apparatus, the metallic support cylinder for the recording sheet itself may be used as the return electrode.

Figure 2:
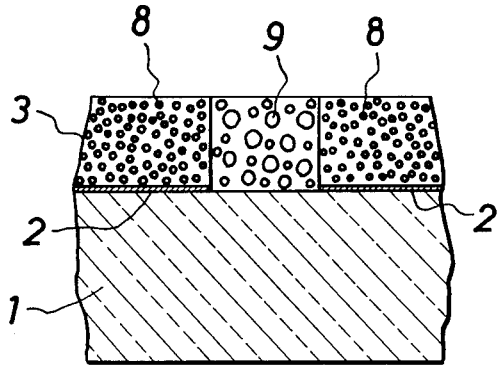
FIG. 2 is a schematic sectional view of the image forming sheet of the invention showing the change of the image portion by electric image formation, in which oxidizable or fusible metal is used as the conductor layer and electrolytically reducible metallic oxide powder is used as the semiconductive layer.
Figure 3A:
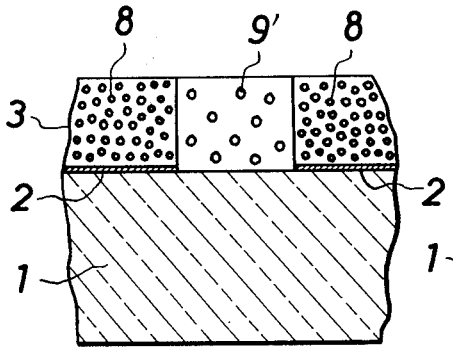
FIG. 3 (*a*) is a schematic sectional view of the image forming sheet after the chemical development.
Figure 3B:
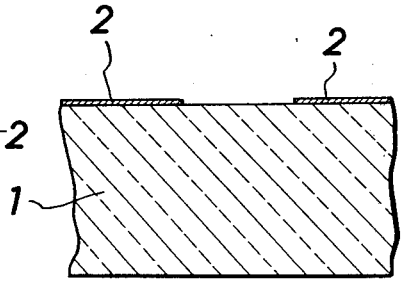

In the image forming sheet of the invention as shown in FIG. 2, the conductor layer 2 is, for example, a metallic, vapor deposited coating such as an aluminum thin layer, and the semiconductive layer 3 is a dispersion of semiconductive metallic oxide powder such as doped zinc oxide, through which the electric current of transmitted signal is applied. Then the semiconductive metallic oxide powder 8 such as doped zinc oxide is electrolytically reduced to free metal and forms somewhat large particles 9, and the conductor layer 2 is completely or almost destroyed because of the passage of the high density electric current and the portion becomes transparent or translucent with the exception of the position of the free metal particles 9 produced in the semiconductive layer 3.

The image forming sheet in the above-mentioned condition can be applied as it is as the negative to some uses where a severe optical contrast is not required because the image portion is substantially translucent and the non-image portion is opaque to form an optical contrast. Where the semiconductive layer is formed of homogeneous conductive polymer, a transparent image sheet with good transparency in the image portion can be obtained. However, it is generally preferable that such transparent image sheet is processed further in order to improve the optical characteristics of the sheet. That is, the contrast to the transmitted light is increased by improving the transparency of the image portion.

For increasing the contrast, "development" is carried out. The word "development" herein used means the treatment for increasing the transparency of the above-mentioned visible translucent image on the sheet to make better the contrast. As this development, there are two different methods, one of which is chemical etching process and the other is physical dissolving and rinsing process.

In the first place, the chemical development will be explained. After the application of electric current to the sheet having the metallic conductor layer 2 and the metallic oxide semiconductive layer 3, the sheet is immersed into or sprayed a corrosive liquid such as aqueous solution of acid, alkali, corrosive metallic salt or chelating agent, thus the corrosive liquid permeates into the layers from the side of semiconductive layer 3. In the meantime, the anticorrosiveness of the original metallic oxide particles 8 and that of the reduced free metallic particles 9 are different, and the permeating rates of the liquid into the image portion and into the non-image portion are different with respect to each other, therefore, the corrosive liquid acts upon the image portion selectively. For example as disclosed in the above, doped zinc oxide is used as the semiconductive layer 3 and vapor deposited aluminum coating is used as the conductor layer 2 of the image forming sheet, and in case the sheet having an image formed is developed with using 2% aqueous hydrochloric acid solution, the hydrochloric acid solution easily permeates into the image portion to reach the conductor layer 2, because the permeability of the image portion applied with electric current is increased very much by the facts that the binder of the semiconductive layer 3 is partially destroyed and the continuity thereof as the film is decreased by the generated heat of the electric current, and the zinc oxide is reduced to metallic zinc of higher density so as to loosen the texture of the layer 3 and becomes chemically activated. Most of the conductor layer 2, in this case aluminum coating, has been already destroyed at the image portion. During the permeation of the corrosive liquid through the semiconductive layer 3, most of the free metal particles 9 are dissolved and only the exceptionally large particles remain undissolved to form the reduced particles 9'. Thus, the image portion becomes further transparent by the chemical development.

If the sheet is left as it is after the chemical development, the reaction will proceed further in excess and the resolving power of the image is decreased, in addition to that the sheet will soil other things, therefore the sheet must be rinsed with sufficient water immediately after the chemical development.

In the following, the physical development will be explained, which is very simple and easy. That is, the image forming sheet after receiving the electric current is immersed into a solvent to dissolve and remove the semiconductive layer 3. Accordingly, the semiconductive layer 3 must be made of a conductive polymer which dissolves easily in the solvent, or of a composition consisting of insoluble fine particle semiconductive component such as metallic oxide and a soluble binder. If the residue of the opaque conductor layer is still present in the image portion, it can be removed together in this physical development by a hydraulic force.

In the application of the electric current with a high current density, a considerable heat generation is caused, thus even though a portion of the conductor layer 2 is left as it is, the adherence to the base 1 is and the continuity of the layer 2 almost lost. Therefore, when the sheet applied with electric current is immersed into a liquid which dissolves the semiconductive layer 3 and does not dissolve the conductor layer 2, the semiconductive layer 3 is dissolved and removed by the liquid, then the remaining opaque conductor layer in the image portion is physically removed to form a completely transparent image. In this case, if the sheet is shaken or vibrated in the treating liquid to give physical shock, the physical removal of the remaining conductor layer 2 may be promoted. As for this treating liquid, it is necessary that the liquid does neither dissolve nor swell the transparent film base 1 in order to expect the excellent resolving power of the obtained sheet.

In case the thickness of the conductor layer is large and it is relatively strong, a considerable part in the direction of the thickness of the conductor layer 2 is left as it is after the application of electric current, and in such case it is difficult to remove the conductor layer 2 by the sole dissolving of the semiconductive layer 3. Then, the image portion may be etched preferably by the previous development as disclosed in the above, and thereafter this physical development may be applied to obtain a completely transparent image.

It is to be noted that each of the chemical development and the physical development alone is sufficient although, and the joint treatment of two methods may be employed where an extremely high transparency is required in the image portion.

Both development methods have their own characteristics, for example, in the chemical development, the semiconductive layer 3 remains on the conductor layer 2 and the former layer protects the sheet, therefore it is advantageous for handling and preserving. On the other hand, some residual matters remain in the image portion, and the transparency of the image portion is somewhat reduced though insignificant. Further, while the corrosive liquid is employed, the waste thereof must be disposed after neutralization or precipitation. While in the physical development, the transparency of the image portion is excellent as there is no foreign matter in the image portion, and if a volatile solvent is used as the treating liquid, the greater part of the waste liquid can be recovered only by distillation, therefore any environmental pollution is not caused, which are the advantages of this method. On the other hand, the conductor layer 2 which is liable to be injured is exposed after the development, therefore in order to improve the preservability of the developed sheet, the sheet must be protected by any way such as applying transparent coating. However, the preservability is not necessary in most cases, and if necessary, the preservability can be improved without fail, therefore it is not the defect of this method.

The characteristic of the present invention is the employment of the above-mentioned semiconductive layer as the image recording layer. Accordingly, a relatively low electric voltage such as from 20 to 70 volts may also be of the elimination of electric discharge, noise, offensive odor and smoke for the formation of the image, there are not produced during the supply of electric current, and there is no fear of soiling of the operation room and fires. Still further, the resolving power of the obtained transparent image on the sheet is excellent, so that if it is used as the original plate for the photosensitive printing plate, the obtained printing plate has sufficient clearness for the type-printings such as newspapers. Accordingly, the printing plates can be electrically transmitted from a distant place, and the printing plates for relief printing, intaglio printing or lithography can be prepared immediately, therefore the printing process can be simplified. Further, in FIG. 1 and its relevant explanation, the example in which the sheet being scanned continuously by the recording stylus is shown, however, the use of the image forming sheet of the invention is not restricted to such example. That is, a conductive article which having a form of the image to be printed at the top surface is used as an electrode and electric voltage is supplied thereto, then it is contacted to the image forming sheet of the invention for an instant, or it is previously contacted to the sheet and the electric voltage is supplied for an instant, the clear image may be formed on the sheet. For example, it may be conveniently used for typewriters, especially for teletypewriters, in which the sheet having clear and transparent images can be prepared easily and quickly.

Further characteristic feature of the present invention is as follows. That is, in the case of the image forming sheet where electrolytically reducible metallic oxide is used, a transparent image having continuous gradation of concentration and akin to the picture of the original photograph is reproduced with high fidelity if the electric signal (applied voltage) in proportion to the shades of the original image is supplied and the controlled chemical development is carried out, because the extent of the formation of the free metallic particles by electrolytical reduction is directly proportional to the amount of the electric current supply which is in close connection with the shade of the original image.

One of the excellent features of the invention is that there is no need of preparing a screen negative for the printing of photographs with continuoug gradation of concentration. In the conventional art of printing, a printing plate for photographs is prepared through the so called halftone photography, and the shade of the each part is converted into the area of the dots. When the image forming sheet of the invention comprising the semiconductive layer composed of reducible metallic oxide is run with facsimile apparatus, i.e., the cylinder bearing the image forming sheet is rotated at a uniform speed and the recording stylus is slided in the direction of the axis of the rotation, the picture is formed as an assembly of straight lines parallel and close to each other which is composed of free metal produced by electrolytic reduction. If the scanning lines are close enough to each other, the stripe disappears and the shade of the original image is converted into the distribution of the free metal particles 9 in the semiconductive layer 3. Therefore, being developed with a controlled condition, the transparent image sheet of the invention is used immediately as the substitute of the screen negative for the preparation of the printing plates for photographs.

The sheet having the transparent image of the present invention has several advantages as disclosed in the above, thus it can be used for the copying by diazotype copy paper, photographic printing, photographic layout, and other purposes using the optical process as well as the above-mentioned usage for the printing process.

With regard to the image forming sheet of the present invention, the construction and the method for preparing and using have been fully explained in the above, and it may be practised according to the understanding from such explanations. In order that the invention may be more fully understood, further explanations will be given in the following.

As disclosed in the above, several materials can be used as the transparent film base 1, while generally, transparent plastic films such as polyester, cellulose acetate, polyvinyl chloride, polyvinylidene chloride, rubber chloride, polypropylene and polyethylene may be used. Other materials such as regenerated cellulose and glass may also be used. The selection of hard material or soft material can be determined according to the convenience and purpose of the use. The thickness of the film base is preferably small as far as it has necessary mechanical strength, and generally the thickness may be in the range of 0.01 to 1 mm. If the film base is very thick in excess, it is heavy and inconvenient in handling, especially in case where it is large excessively, the resolving power is often lost by the scattering of the light through the base layer.

As for the opaque conductor layer 2, several materials can be used. For example, a vapor deposited metallic or carbonaceous layer, a metallic foil laminated onto the base film or applied coating composition containing conductive powdery substance such as metallic powder, carbon black, graphite or titanium sesquioxide may be used. The conductive coating composition may contain a binder resin like those which will be specified later in connection with the semiconductive layer. However, regarding the uniformity of thickness, continuance, appearance, stability and ease of image forming and developing, the vapor deposited coating of metal is generally preferred, and the vapor deposited coating of aluminum is most preferable in view of the cost and the convenience of the development of image. And in order to shield the light effectively in the non-image portion and to carry out the development easily, the thickness of such coating may be in the range of 0.01 to 1 micron preferably.

As mentioned in the above, there are three kinds of the semiconductive layer 3, one of which is composed of electrolytically reducible, semiconductive metallic compounds. As such compounds, semiconductive metallic oxides such as doped zinc oxide and titanium oxide is suitable.

In order to give semiconductivity to non-conducting metallic oxides, for example, impurity elements are doped to the oxide particles. For instance, in case of the zinc oxide, 0.001 to 10% by molar ratio of trivalent or tetravalent metallic salts such as aluminum, gallium, iron, chromium, tin and silicon salts are added to the surfaces of said zinc oxide particles, and thereafter it is calcined at 900° to 1300°C. Thereby, the semiconductive powder having a volume resistivity of $10^3$ to $10^6$ ohm·cm can be obtained. As the binder which is used in combination with the above semiconductive particles, almost all soluble polymers may be used except those which react the semiconductive particles or the like and the conductive layer. For example, epoxy resin, ureaformaldehyde resin, melamine-formaldehyde resin, alkyd resin, polyurethane, polyvinyl acetate, polyvinyl chloride, polyamide, polybutadiene, acrylic resin, cellulose derivatives, polyester and the like can be employed. They are used solely or as a mixture of those which are compatible. In the meantime, thermosetting polymers are suitable for receiving the chemical development process in order to keep the mechanical strength, and thermoplastic polymers which have solubility after forming the hardened layer are suitable for receiving the physical development process. The ratio of the metallic oxide semiconductor powder to the binder may be from 1.5 to 10 times by weight. If necessary, any of other solvents, plasticizers, metallic soaps and/or hardening agents can be added into the above composition, and thus prepared liquid composition is applied to the conductor layer 2 to form the semiconductive layer 3.

Alternatively, the semiconductive metallic compounds may be substituted by a mixture of non-conductive metallic compounds and conductive substances such as metallic powder, carbon black or powdery graphite. The particle size of the conductive substances should be as fine as several microns or less in order to obtain a high resolving power. The nonconductive metallic compounds may be selected widely from the pigments for coatings and plastics such as zinc oxide, titanium dioxide, lithopon, iron oxide, chromium oxide, barite, calcium carbonate or clay. However, inorganic chemicals including those not used as pigments which are electrochemically denatured and increase corrosive property by developing liquid are used preferably. For example, zinx oxide, titanium dioxide, cadmium oxide, cadmium sulfide, zinc selenide, antimony oxide, zinc titanate, barium titanate, silver oxide, selenium oxide, zirconium oxide. Or vanadium pentoxide is used as an electrolytically reducible metallic compound in the semiconductive layer. The ratio of the both materials, namely the non-conductive inorganic compound and the conductive substance, is such that to form a semiconductive layer having a volume resistivity of $10^3$ to $10^6$ ohm·cm. Thus, the mixture is dispersed in a suitable binder resin and the conductive substance should form 1 to 30 weight % of the whole film forming components.

As the shielding power of the semiconductive layer is not necessary, so that it can be very thin, however, if it is excessively thin, the resistance value decreases unduly with fear of electric discharge and the substantial effect thereof in the developing can not be expected. On the other hand, if the layer is excessively thick, higher electric voltage is required for forming image and more of time has to be consumed for developing. Therefore the dried thickness of the semiconductive layer may be 2 to 50 microns, preferably 5 to 25 microns, and the thickness of 8 to 15 microns is most suitable.

As the conductive polymers which can be used as the semiconductive layer, there are, for example, polyvinyl benzyl quaternary ammonium salts, polyvinyl carbazole, polyethyleneimine derivatives, oligostyrene sulfonate and polymer or copolymer of ethylenically unsaturated phosphoric ester. They are dissolved into a proper solvent and applied to the conductive layer 2 to form a coating of 1 to 20 microns in dried thickness as the semiconductive layer 3. The surface resistivity of the semiconductive layer composed of homogeneous conductive polymer is preferably from $10^4$ to $10^9$ ohms.

As the treating solution for the chemical development, the aqueous solutions of corrosive acids, alkalis or corrosive salts such as hydrochloric acid, nitric acid, phosphoric acid, sulfuric acid, formic acid, acetic acid, propionic acid, butyric acid, oxalic acid, hydroxysuccinic acid, citric acid, phenolsulfonic acid, sodium hydroxide, potassium hydroxide, lithium hydroxide, strontium hydroxide, sodium carbonate, ferric chloride, potassium ferrocyanide, ammonium thiocyanide, and ammonium phosphates can be used. They are used solely or together otherwise they react to each other and the effectiveness is lost. The concentration of the solutions may be in the range of 0.1 to 30 % by weight, and preferably 0.5 to 10 % by weight, and a certain surfactant which is stable and acts effectively in the corrosive liquid, for example a non-ionic surfactant of polyethyleneglycol alkyl ether series, may also be added into the solution to accelerate the removal of the insoluble dregs adhering to the surface of the transparent base film. The temperature of the solution is not restricted but generally is the room temperature. The time for the development is less than 30 minutes, and is 1 to 10 minutes in general cases.

As the treating solutions for the physical development, solvents for the conductive polymer or binder resin are used, and taking the rapidity of development, drying after the development, fear of catching fire and cost into consideration, one or a mixture of methyl isobutyl ketone, methyl ethyl ketone, toluene, xylene, tetrahydrofuran, butyl acetate, N, N-dimethyl formamide, dimethyl sulfoxide, trichloroethylene, perchloroethylene, water and ethyl alcohol can be used.

In the following, the invention will be explained further with some specific examples.

EXAMPLE 1

A polyester film of 50 microns in thickness was coated with aluminum by vapor deposition in vacuum on one side. Then a semiconductor composition containing 80 % by weight of powder of zinc oxide semiconductor against the total non-volatile matter was prepared and the composition was applied on said aluminum coated surface of the film to form the semiconductive layer of 6 microns in dried thickness. Thereby the image forming sheet of the invention was obtained. Said powder of zinc oxide semiconductor had a volume resistivity of $2.6 \times 10^4$ ohm·cm and was prepared by doping zinc oxide powder with 0.1 % by mole of aluminum. The binder as used for the above was composed of three parts by weight of Epikote 1004 (epoxy resin of Shell Chem. Corp.) and two parts by weight of Versamide 100 (polyamide resin of General Mills Inc.) as curing component.

Thus obtained image forming sheet was set to a facsimile apparatus, and the resolving power test chart was copied with the electric signal of 30 volts scanning speed of 1 m/sec and line density of 20/mm, using a pin electrode of 0.15 mm diameter. After that, the sheet was developed by dipping in 2 % hydrochloric acid for 1 minute at room temperature, then it was rinsed with tap water and dried to obtain the sheet with transparent images. The resolving power of thus obtained image was twenty lines per millimeter.

EXAMPLE 2

As image forming sheet was prepared in like manner as the foregoing Example 1 except that Dianal Beads Resin 102 (thermoplastic acrylic resin of Mitsubishi Rayon Co., Ltd., Japan) was used as the binder for the semiconductive layer. This sheet was fitted to the facsimile apparatus and the resolving power test chart was copied with the electric signal of 60 Volts and scanning speed of 2 m/sec. Then this sheet was developed by methyl isobutyl ketone with shaking for several minutes to dissolve off the semiconductive layer.

Then the sheet was dried to obtain the complete sheet having transparent images, the resolving power of which was 30 lines per millimeter.

EXAMPLE 3

An aluminum foil of 6 microns in thickness was adhered to one side of a polyester film of 100 microns in thickness using thermosetting adhesive. The aluminum surface of thus obtained laminated sheet was applied with the zinc oxide semiconductor composition as used in said Example 2 to form the semiconductive layer of 10 microns in dried thickness, thereby the image forming sheet of the invention was prepared.

Thus obtained image forming sheet was contacted with a metal piece of about 3 $cm^2$ as the return electrode, and this electrode was connected to the negative terminal of 40 volts smoothed DC power source, and a 10 point metallic printing types were connected to the other terminal of said power source. Then these types were contacted progressively at a moment to the sheet where about 50 mA of current flowed, thereby black images like the type faces were formed clearly on the sheet.

Thereafter, this sheet was immersed into an acidic 10 % ferric chloride solution for 3 minutes at room temperature, and after rinsing with water, the sheet was further immersed into methyl ethyl ketone with vigorous shaking for 5 minutes to remove the whole of the semiconductive layer and the image portion of the aluminum foil. Thereby, the sheet was formed with a clear transparent image.

This transparent image sheet was then contacted with a photosensitive resin plate (Sonne KPM 2000 made by Kansai Paint Co., Ltd., Japan), and was irradiated with light from Chemical Lamp (type: SL-20BL made by Tokyo Shibaura Electric Co., Ltd., Japan) at 6 cm distance apart for 5 minutes to harden the image portion of said photosensitive resin plate. Then the plate was sprayed with 0.2 % caustic soda solution, rinsed further with water and dried. Thereby, a relief printing plate was obtained and a clear printing was carried out by using said printing plate.

EXAMPLE 4

The aluminum-deposited polyester film as used in the foregoing Example 1 was applied with a semiconductive layer of conductive polymer having 3 microns in thickness. This conductive polymer was polyvinyl benzyl quaternary ammonium salt, DOW ECR 34 (a tradename of Dow Chemical Co., USA), and the surface resistivity of this conductive polymer coating was $2.2 \times 10^8$ ohms.

Thus obtained image forming sheet was fitted to the facsimile apparatus and the resolving power test chart was copied by the electric signal of D.C. 60 volts with the scanning speed of 1 m/sec, and line density of 20/mm.

Then the sheet was immersed into a mixture of water and ethyl alcohol in the ratio of 1 : 1 by weight and was shaken for several minutes to carry out the development.

The obtained sheet having the transparent image was very excellent and the resolving power of which was 10 lines per millimeter.

EXAMPLE 5

The image forming sheet obtained in Example 1 was set to a facsimile apparatus and a form of a newspaper containing a screen-processed photograph (a portrait) and Chinese letters were copied with similar recording condition like Example 1, then the sheet was developed by dipping into aqueous acid solution containing phosphoric acid and nitric acid 3 weight % each, at room temperature.

A lithographic printing plate for offset printing was prepared using the above transparent image sheet as the negative and a presensitized photo-lithographic plate (trade name "GNK", manufactured by Fuji Shashin Film Co., Ltd., Japan).

The paper prints obtained by offset printing using the printing plate thus prepared were extremely clear as compared with prints obtained using a lithofilm from camera work and a photosensitive resin relief plate.

EXAMPLE 6

The image forming sheet obtained in Example 1 was set to a facsimile apparatus and a photograph (paper print) with continuous gradiation of concentration (a portrait) was copied to form a transparent image on the sheet followed by developing like in Example 5.

A photographic pinting paper (trade name "Gekko-V2", manufactured by Mitsubishi Seishi Co., Ltd., Japan) was exposed to light through the above transparent image sheet used as the negative and developed in normal condition.

Thus obtained photograph was quite akin to the original and the stripes due to scanning was not observed.

EXAMPLE 7

A lithographic printing plate for offset printing was prepared using the transparent image sheet obtained in Example 6 and a similar presensitized photolithographic plate like in Example 5.

Extremely fine paper prints of photograph were obtained using the above printing plate despite of elimination of the conventional screen process (half-tone process).

EXAMPLE 8

A coating composition for the conductor layer of image forming sheets was obtained by dispersing 40g of conductive carbon black (trade name "Corax L" manufactured by Degussa, West Germany) in 100g at polybutadiene (average molecular weight 5,500, trade name "LCB-150" manufactured by Nippon Zeon Co., Ltd.) and 1g of triethanolamine as curing agent.

The above composition was applied to transparent cellulose acetate film 100 microns in thickness and cured by stoving at 80°C for 1 hour to form a conductor layer of about 8 microns dry thickness. The conductor layer had volume resistivity of $2 \times 10^2$ ohm·cm.

Then the semiconductive composition prepared in Example 1 was applied to the above conductor layer and a semiconductive layer of 15 microns dry thickness was formed.

Thus obtained image forming sheet was set to a facsimile apparatus, and the resolving power test chart was copied to form a transparent image in similar conditions like in Example 1 except that the electric voltage applied was 65 volts. Then the sheet was developed with 3 % hydrochloric acid containing 0.2 % of nonionic surfactant (polyethyleneglycol lauryl ether).

The transparent image sheet thus obtained had resolving power of 10 lines/mm.

EXAMPLE 9

Zinc oxide (for coating) 194g, powdery graphite (trade name "G-6", manufactured by Chu-etsu Graphite Co., Ltd., Japan) 6g and 24g as resin solid of Versamide 400 (polyamide resin of General Mills Inc.) were together dispersed using a pebble mill with isopropyl alcohol and toluene for viscosity adjustment during 24 hours. Then, 24g as resin solid of Epikote 1001 (epoxy resin of Shell Chemical Corp. in solution and 24g of zinc stearate are added to form a semiconductive coating composition. The volume resistivity of the film prepared from the composition was about $8 \times 10^5$ ohm·cm.

A transparent image forming sheet is prepared applying the above composition to a transparent polyester film of 50 microns in thickness with a vapor deposited aluminum layer. The dried thickness of the semiconductive layer was 10 microns.

Thus obtained image forming sheet was fitted to a facsimile apparatus, and resolving power test chart was copied with a recording condition similar to Example 1 except that the applied voltage was 120 volts. The line drawing part was further blacker and the aluminum layer was lost therefrom.

The sheet was next immersed in an aqueous acid solution containing phosphoric acid and nitric acid 5 weight % each for 1 minute at room temperature. As a result, the transparency at the line drawing part was extremely intensified, and thus obtained transparent image sheet had high resolving power enough for photographic printing on printing paper.

EXAMPLE 10

A semiconductive coating composition was prepared in like manner as Example 5 except that 156g of zinc oxide and 44g of zinc dust as aa substitute of powdery graphite were used. The volume resistivity of the film made of the composition was $1.2 \times 10^6$ ohm·cm.

A similar image forming sheet was prepared and tested like in Example 5 and again a favourable result was obtained.

EXAMPLE 11

A semiconductive coating composition was prepared in like manner as example 5 except that 188g of zinc sulfide as a substitute of zinc oxide 12g of powdery graphite were used. The volume resistivity of the film made of the composition was $2.1 \times 10^4$ ohm·cm.

A transparent image forming sheet was prepared in like manner as Example 5 and a negative was obtained by copying a photograph having continuous gradation of concentration (a portrait) on thus obtained image forming sheet using a facsimile apparatus without screen process. Then a lithographic printing plate for offset printing was prepared with the above negative and a presensitized photolithographic plate (trade name "GNK" manufactured by Fuji Shashin Film Co., Ltd., Japan)

The paper prints made by offset printing using thus obtained printing plate showed high fidelity of reproduction and stripes by scanning with the stylus was not observed.

Through the above detailed descriptions, the features and advantages of the present invention may be fully understood, however, it should be emphasized that the specific examples described and shown herein are intended as merely illustrative and in no way restrictive of the invention.

What is claimed is:

1. A method for forming a transparent image on a sheet which comprises the steps of: providing a sheet having a transparent film base, an opaque conductor layer formed on one side of said transparent film base, and a semi-conductive layer formed on said opaque conductor layer having a volume resistivity of $10^3$ to $10^6$ ohm·cm; applying from 10 to 70 volts between said opaque conductor layer and a stylus electrode contacting the surface of said semi-conductive layer and simultaneously rendering transparent or translucent those portions of the semi-conductive and conductor layers underlying said stylus forming an image; contacting the thus formed image sheet with a liquid for removing said semi-conductive layer at least in the image portion, said semi-conductive layer being formed from one of (1) a uniform dispersion of semi-conductive metal oxide particles in a binder, (2) a uniform dispersion of non-conductive particles and conductive substances in a binder, and (3) a homogeneous conductive polymer.

2. A method for forming a transparent image as claimed in claim 1, in which said liquid for removing said semi-conductive layer comprises water or an organic solvent selected from the group consisting essentially of methyl isobutyl ketone, methyl ethyl ketone, toluene, xylene, tetrahydrofuran, butyl acetate, N, N-dimethyl formamide, dimethyl sulfoxide, trichloroethylene, perchloroethylene, and ethyl alcohol.

3. A method for forming a transparent image as claimed in claim 1, wherein said semi-conductive layer has a volume resistivity of $10^3$ to $10^6$ ohm·cm, a thickness of 2 to 50 microns and comprises a uniform dispersion of semi-conductive metal oxide particles in a non-conductive polymeric organic binder, said particles being reduced to free metal by application of said voltage thereby rendering transparent or translucent that portion of the semi-conductive layer being contacted by said stylus, said liquid is a corrosive liquid for the free metal produced in said semi-conductive layer in said image portion which is selected from the group comprising aqueous solution of one or a mixture of hydrochloric acid, nitric acid, phosphoric acid, sulfuric acid, formic acid, acetic acid, propionic acid, butyric acid, oxalic acid, hydroxysuccinic acid, citric acid, phenolsulfonic acid, ferric chloride, potassium ferrocyanide, ammonium thiocyanate and phosphates of ammonium.

4. A method for forming transparent image as claimed in claim 1, wherein said opaque conductor layer comprises a vapor deposited coating of aluminum.

5. A method for forming transparent image as claimed in claim 1, wherein said semiconductive layer comprises a polymeric organic binder having metallic oxide semi-conductor doped zinc oxide or titanium oxide particles which are electrolytically reducible dispersed therein.

6. A method for forming transparent image as claimed in claim 1, wherein said semiconductive layer comprises a mixture of conductive substances comprising metallic powder, carbon black or powdery graphite, and non-conductive particles comprising zinc oxide, titanium dioxide, lithopon, iron oxide, chromium oxide, barite, calcium carbonate, clay, cadmium oxide, cadmium sulfide, zinc selenide, antimony oxide, zinc titanate, barium titanate, silver oxide, selenium oxide, zirconium oxide or vanadium pentoxide.

7. A method for forming transparent image as claimed in claim 1, wherein said semiconductive layer is formed from a homogenous conductive polymer selected from the group consisting of polyvinyl benzyl quaternary ammonium salts, polyvinyl carbazole, polyethyleneimine derivatives, oligostyrene sulfonate and polymers or copolymers of ethylenically unsaturated phosphoric ester.

8. A method for forming transparent image on a sheet comprising a transparent film base, an opaque conductor layer being formed on one side of said transparent film base, and a semiconductive layer being formed on said opaque conductor layer comprising a uniform dispersion of metal compound particles in a non-conductive and polymeric organic binder, said particles being reduced to free metal by application of electric voltage, comprising the steps of:

A. applying electric voltage from 20 to 70 volts between said opaque conductor layer and a needle electrode contacting the surface of said semiconductive layer having a thickness of 2 to 50 microns and a volume resistivity of $10^3$ to $10^6$ ohm·cm where the image is formed;

B. contacting the formed image sheet with a corrosive liquid comprising an aqueous solution of a substance selected from the group consisting of hydrochloric acid, nitric acid, phosphoric acid, sulfuric acid, formic acid, acetic acid, propionic acid, butyric acid, oxalic acid, hydroxysuccinic acid, citric acid, phenolsulfonic acid, ferric chloride, potassium ferrocyanide, ammonium thiocyanate and phosphates of ammonium to selectively remove the semiconductive layer and the opaque conductor layer in the image portion; and C. further contacting the image sheet with water or an organic solvent selected from the group consisting essentially of methyl isobutyl ketone, methyl ethyl ketone, toluene, xylene, tetrahydrofuran, butyl acetate, N,N-dimenthyl formamide, dimethyl sulfoxide, trichloroethylene, perchloroethylene, ethyl alcohol to remove the remaining semiconductive layer.

9. A method for forming transparent image as claimed in claim 1, wherein said semiconductive layer has a volume resistivity of $10^3$ to $10^6$ ohm·cm, a thickness of 2 to 50 microns and is comprised of a uniform dispersion of a mixture of fine non-conductive metallic compound particles and fine conductive particles in a non-conductive and polymeric organic binder, said liquid is a corrosive liquid for the free metal produced in said semi-conductive layer in said image portion selected from the group consisting essentially of aqueous solution of one or a mixture of hydrochloric acid, nitric acid, phosphoric acid, sulfuric acid, oxalic acid, hydroxysuccinic acid, citric acid, phenolsulfonic acid, ferric chloride, potassium ferrocyanide, ammonium thiocyanate and phosphate of ammonium.

10. A method for forming transparent image as claimed in claim 1, herein said semi-conductive layer has a surface resistivity of $10^4$ to $10^9$ ohms, a thickness of 2 to 50 microns and comprises a homogeneous conductive polymer, and said liquid for removing said semi-conductive layer is water or an organic solvent selected from the group consisting essentially of methyl isobutyl ketone, methyl ethyl ketone, toluene, xylene, tetra hydrofuran, butyl acetate, N,N-dimethyl formamide, dimethyl sulfoxide, trichloroethylene, perchloroethylene and ethyl alcohol.

* * * * *

UNITED STATES PATENT AND TRADEMARK OFFICE

CERTIFICATE OF CORRECTION

PATENT NO. : 3,935,333

DATED : January 27, 1976

INVENTOR(S) : Harunobu Muneoka et al

It is certified that error appears in the above-identified patent and that said Letters Patent are hereby corrected as shown below:

Column 5, line 5, after "although" delete "and";

Column 5, line 36, after "may also be" insert --applied for the formation of the image. Further, because--;

Column 5, line 39, after "image" delete "there" and insert -- these --;

Column 5, line 50, after "simplified" insert "an reduced--;

Column 12, line 10, after "a" delete the additional "a";

Claim 8, line 31, change "dimenthyl" to --dimethyl--.

Signed and Sealed this

Seventh Day of September 1976

[SEAL]

*Attest:*

RUTH C. MASON
*Attesting Officer*

C. MARSHALL DANN
*Commissioner of Patents and Trademarks*